United States Patent [19]

Deering et al.

[11] 4,025,416

[45] May 24, 1977

[54] SHALE RETORTING PROCESS

[75] Inventors: Roland F. Deering, Brea; Roland O. Dhondt, Long Beach; Thomas A. Seesee, Newport Beach, all of Calif.

[73] Assignee: Union Oil Company of California, Los Angeles, Calif.

[22] Filed: Dec. 18, 1975

[21] Appl. No.: 642,151

[52] U.S. Cl. ..... 208/11 R; 201/32

[51] Int. Cl.[2] ..... C10G 1/02

[58] Field of Search ..... 208/11 R; 201/31.32

[56] References Cited

UNITED STATES PATENTS

| | | | |
|---|---|---|---|
| 3,133,010 | 5/1964 | Irish et al. | 208/11 R |
| 3,318,798 | 5/1967 | Kondis et al. | 208/11 R |
| 3,361,644 | 1/1968 | Deering | 208/11 R |
| 3,574,087 | 4/1971 | Bergen | 208/11 R |

*Primary Examiner*—Delbert E. Gantz
*Assistant Examiner*—James W. Hellwege
*Attorney, Agent, or Firm*—Lannas S. Henderson; Richard C. Hartman; Dean Sandford

[57] ABSTRACT

Crushed oil shale is subjected to eduction in a solids-upflow or -downflow retort in contact with a preheated counter-currently flowing eduction gas comprising a recycled portion of the retort make gases. The problem of shale particle agglomeration is avoided by correlating the eduction gas flow rate and temperature so as to insure that the 750°–850° F shale temperature interval in the retort is maintained at a level sufficiently high in the retort that the total shale, or "rock" pressure bearing down on said interval is insufficient to bring about agglomeration. It is found that the problem of agglomeration is critical to the 750°–850° F temperature range, and that there is a definite correlation between the oil assay of the raw shale and the permissible rock pressure which the shale particles in this temperature range can withstand without undergoing agglomeration. Provision is made for shifting the 750°–850° F zone upwardly or downwardly in the retort.

26 Claims, 2 Drawing Figures

SHALE RETORTING PROCESS

BACKGROUND AND SUMMARY OF INVENTION

Perhaps the most widely used basic concept in oil shale retorting involves countercurrently contacting a stream of crushed oil shale with a stream of preheated eduction gas. In this manner, a temperature gradient is set up in the moving shale bed, including a hot eduction zone near the gas inlet to the retort, and an oil condensation, shale preheating zone near the shale inlet end of the retort. In the solids downflow mode of operation wherein the shale is moved by gravity, a persistent problem has been that of shale agglomeration. At temperatures in the range of about 750°–850° F, the shale particles become somewhat plastic in nature and tend to form agglomerates which seriously impede gas flow, and may in some cases actually cause bridging of the retort with total stoppage of solids flow. To the best of our knowledge, this problem of agglomeration in solids-downflow retorting has never heretofore been solved in any practical manner. Another major problem in this type of retorting has been that of preventing condensed shale oil in the cool, upper condensation zone from refluxing downwardly into the hot eduction zone, with resultant excessive cracking.

Considerable progress was made in solving the foregoing problems by resorting to the solids-upflow, gas-downflow retorting technique such as that described in U.S. Pat. No. 3,361,644. In this process oil shale is fed upwardly through a vertical retort by means of a reciprocating piston. The upwardly moving shale bed continuously exchanges heat with a downflowing high specific heat, hydrocarbonaceous recycle gas introduced into the top of the retort at about 950°–1200° F. In the upper section of the retort (the pyrolysis zone), the hot recycle gas educes hydrogen and hydrocarbonaceous vapors from the shale. In the lower sections of the retort the oil shale is preheated to pyrolysis temperatures by exchanging heat with the mixture of recycle gas and educed product vapors. Most of the heavier hydrocarbons condense in the lower portion of the retort, and are continually swept away from the hot pyrolysis zone and are collected at the bottom of the retort as product oil. The uncondensed gas is then passed through external condensing or demisting means to obtain more product oil. The remaining gases are then utilized as high BTU product gas, recycle gas as above described, and as fuel gas to preheat the recycle gas up to the above specified temperatures.

While the solids upflow technique completely avoids the refluxing and overcracking problem encountered in solids downflow processes, it does not in all cases completely avoid the solids agglomeration problem. Although there is no danger of the retort becoming bridged by agglomerated shale, sufficient agglomeration does in some cases occur to impede uniform gas flow, with resultant excessive pressure drops, reduced oil yields and diminished throughput rates. Here again, the critical region of agglomeration is the 750°–850° F zone in the retort. Although the rock pressure bearing on this zone is less than that normally prevailing in solids downflow retorting, it has been found that under some conditions the rock pressure is sufficient to bring about some agglomeration in that zone. (It will be understood that at temperatures below about 750°, the shale particles have not yet reached a plastic stage, and that after passing through the 750°–850° F zone sufficient eduction has occurred to again render the shale particles non-plastic.)

We have now discovered however that there is a relationship which exists between the oil assay of the fresh shale and the rock pressure which will bring about agglomeration in the 750°–850° F zone. Shales having a high oil assay, above about 35 gallons per ton, will agglomerate and impede gas flow at solids pressures above about 3 psi bearing upon the 750°–850° F zone. Shales of lower assay can withstand considerably higher solids pressures without agglomeration. We have found that the level of the 750°–850° F temperature interval in the retort can be controlled in response to oil assay of the raw shale so as to render the rock pressure bearing upon that interval insufficient to bring about significant agglomeration, in either solids-upflow or -downflow retorting.

The overall objective is to provide sufficient total heat input into the retort to obtain the desired solids temperature at the solids outlet end of the retort (900° F or higher) without heating the solids to the 750°–850° F range at a level in the retort where the rock pressure is high enough to cause agglomeration. This objective is achieved by selecting the right combination of recycle gas rate and temperature. At the same total heat input, the position of the critical 750°–850° F zone can be raised or lowered in the retort by proper correlation of recycle gas rate and temperature. The combination of high temperatures and low recycle gas rates will elevate the critical zone sufficiently to avoid agglomerating pressures for any oil shale of up to about 60 gallons per ton Fischer assay. However, it is usually undesirable to maintain high recycle gas temperatures unless a high assay shale is being retorted, for preheating the recycle gas to above about 1050° F tends to cause thermal cracking of hydrocarbons in the recycle gas, and more rapid coking of the recycle gas heater. When shales of lower oil assay are being retorted, it is therefore preferable to reduce the recycle gas temperature and increase the flow rate thereof. This lowers the level of the 750°–850° F zone. However the recycle gas rate should not be too high or the shale will reach the critical 750°–850° F temperature range at a level where solids pressures are too high and agglomeration can occur.

We have now found that high oil yields and high throughput rates can be obtained without agglomeration in a solids upflow retort when feeding shales of 30–35 gallons per ton Fischer assay by adjusting the recycle gas rate and recycle gas inlet temperature to obtain a temperature profile which approaches a uniform slope when temperature is plotted against bed height. When richer shales are fed to the retort, to the point where agglomeration and plugging begin to occur, such agglomeration and plugging can be avoided by decreasing the recycle gas flow rate and increasing the gas inlet temperature so as to obtain a higher rate of solids temperature increase per unit change in bed height near the top of the retort as compared to the rate of temperature increase per unit change in bed height in the bottom half of the retort.

From the foregoing, it will be apparent that there is a critical intermediate temperature interval of about 750°–850° F in the shale bed. Further, the horizontal level of this intermediate temperature zone can be shifted upwardly or downwardly in the shale bed by suitably correlating eduction gas temperature and flow rate. Also, the middle of said intermediate temperature zone, i.e., the 800° F level, should not be below a critical level at which shale agglomeration at any point within said zone becomes significant, said critical level being directly related to the oil assay of the shale being fed to the retort. Resorting to this relationship, said critical level can be defined as that level at which the rock pressure bearing thereon in pounds per square inch is about $(120{,}000/(F.A.)^3+0.5$, where F. A. is the Fischer assay of said shale, in gallons per ton. Preferably however, the 800° F level of said intermediate temperature zone is no lower in the bed than the level at which the rock pressure is $(100{,}000/(F.A.)^3+0.5$ pounds per square inch. However, in order to minimize thermal cracking of hydrocarbons in the recycle gas preheater, as well as over-cracking in the upper high-temperature portion of the shale bed, the top of said intermediate temperature zone, i.e. the 850° F level, should preferably be at least about 1 foot below the top of the shale bed in a solids upflow retort. (It should be noted that the foregoing formulations based on rock pressure cannot be accurately and conveniently expressed in terms of bed depth; the former is not a simple linear function of the latter.)

One aspect of the invention contemplates the retorting of shale feeds which may vary substantially, e.g. by at least 5 gallons per ton, in oil assay from time to time. In such cases, the intermediate temperature zone will be maintained at a relatively low level in the shale bed when the shale feed assays relatively lean in oil, and at a higher level when the feed assays relatively rich in oil, the lower level and the higher level each preferably being at least about one foot below the top of the bed, but sufficiently high therein to substantially prevent agglomeration of shale particles.

DETAILED DESCRIPTION

Any of a large number of naturally occurring oil producing shales can be used herein. The characteristics of these materials are generally well known and hence need not be described in detail. For practical purposes however, the raw shale should contain at least about 10, preferably at least 20 and usually between about 25 and 75 gallons of oil per ton of raw shale by Fischer assay. The shale should be crushed to produce a raw feed having no particles greater than 6 inches, and preferably none greater than 3 inches mean diameter. Average particle sizes of about ⅛ to 2 inches mean diameter are preferred. Successful retorting of such shales in the mode described herein generally requires a total heat input ranging between about 350,000 and 450,000 BTU's per ton of shale.

Figure 1:
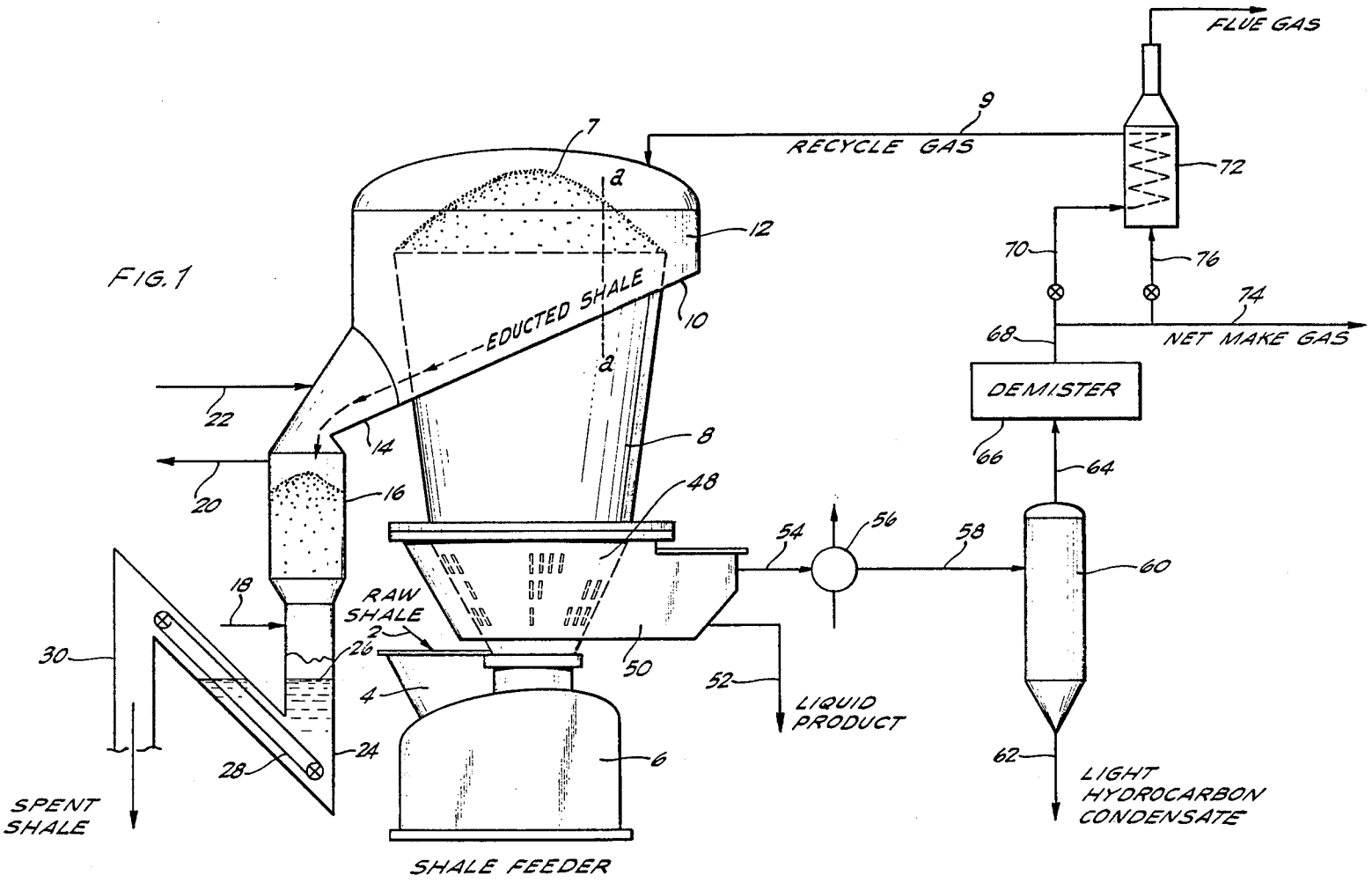
FIG. 1 is a simplified flow diagram illustrating a preferred mode in which the process of this invention is practiced.

Referring now to FIG. 1, the raw shale feed is fed at 2 into hopper 4 of shale feeder 6 from which it is pumped upwardly into retort 8. The details of shale feeder 6 are described in more detail in the above noted U.S. Pat. No. 3,361,644. The shale feed rate will of course vary considerably depending upon the size of the retort and the desired holding time therein.

The raw shale passes upwardly through retort 8, traversing a lower preheating zone and an upper pyrolysis zone. Temperatures in the lower portion of the retort are sufficiently low to condense product oil vapors from the superjacent pyrolysis zone. As the shale progresses upwardly through the retort its temperature is gradually increased to eduction levels by countercurrently flowing eduction gases which include a preheated recycle portion of retort make gas from line 9. Eduction gas temperatures are conventional, ranging between about 600° F and 1100° F, preferably between about 700° and 1000° F. Essentially all of the oil will have been educed from the shale by the time it reaches a temperature of about 900° F. Gas tempertures above about 1300° F in the eduction zone should not be exceeded since they result in excessive cracking of the product oil. Other retorting conditions include shale residence times in excess of about 10 minutes, usually about 30 minutes to 2 hours, sufficient to educe the maximum amount of oil at the selected retort temperatures. Shale feed rates usually exceed about 100, and are preferably about 1000 – 2000 pounds per hour per square foot of cross-sectional area in the retort. These values refer to average cross-sectional areas in the tapered retort illustrated in the drawing.

Pressure in the retort may be either subatmospheric, atmospheric or superatmospheric. Generally, retorting pressures range between about 5 and 400 psig, preferably about 10–50 psig.

The critical temperature profile required in the retort to prevent shale agglomeration is achieved by suitably correlating the eduction gas temperature and flow rate thereof. Those skilled in the art of heat transfer will be well aware that the type of solids temperature profile established in the retort at any given shale feed rate is a simple function of the temperature, heat capacity and flow rate of the eduction gas. At a given heat capacity and total heat input, a sharply ascending temperature profile in the gas inlet portion of the retort is achieved by heating the recycle gas to relatively high temperatures and reducing the flow rate thereof. For this mode of operation (steep profile) recycle gas rates between about 12 and 13 mscf/ton of shale, and gas temperatures between about 980° and 1100° F are preferred. This mode of operation is generally utilized for raw shale feeds having a Fischer assay above about 35 gallons per ton. For retorting such shales, the rate of temperature increase of the shale in the first 4 feet of bed from the gas inlet end of the retort should be about 50–100° F per foot of bed height.

For retorting shales of lower Fischer assay, it is preferred to establish a temperature profile such that the rate of temperature increase of the shale in the first 4 feet from the gas inlet end of the retort increases about 25–50° F per foot of bed height, and further to provide a substantially linear profile throughout the retorting zone. For this mode of operation, typical recycle gas rates range between about 13 and 15 mscf/ton of shale, and temperatures between about 925° and 1000° F.

The foregoing values for recycle gas rates and temperatures should not however be construed as limiting. Depending upon the shale feed rate, the desired degree of completion of retorting, and the recycle gas temperature, suitable temperature profiles may be established over a wide range of gas flow rates, ranging between about 8 and 20 mscf/ton of raw shale. Some precaution should be exercised however to avoid excessive temperature differentials between gas and solids at any level of the retorting zone. Generally such temperature differentials should range between about 10° and 100° F.

The retorted shale, 7, overflowing the top of retort 8 falls onto the inclined peripheral floor 10 of shroud 12, which is affixed in fluid-tight fashion to the outer wall of the retort. The retorted shale then gravitates down floor 10 through chute 14 into collection vessel 16. The retorted shale at this point is essentially oil free and will contain at least about 2 percent, usually between about 3 percent and 5 percent by weight of carbon as coke.

Collection vessel 16 may serve any of several purposes. In the modification illustrated, steam and/or water is injected via line 18 to recover the sensible heat in the spent shale, generating high temperature steam which is taken off via line 20 and may be used to supply heat or mechanical energy requirements of the process. Alternatively, collection vessel 16 may serve as a combustor into which air is injected to combust the coke, thereby generating additional process heat. In still another modification, vessel 16 may serve as a gasifier in which the coke is gasified with steam and oxygen to produce a hydrogen-containing off-gas. In any of these modifications, it may be desirable to inject an inert seal gas via line 22 in order to isolate the gases in vessel 16 from the retort gases.

Spent, cooled shale from vessel 16 gravitates downwardly into a water sealing leg 24, in which a water level 26 is maintained in order to permit the operation of retort 8 at superatmospheric pressures. Spent shale at the bottom of sealing leg 24 is then conveyed via drag-chain conveyor 28 to spent shale discharge chute 30.

In shale retort 8, eduction gases and product oil flow downwardly into the cooler, condensing portion thereof, and thence into slotted, frusto-conical liquid-vapor disengagment zone 48, from which product oil and vapors flow into product collection tank 50. Liquid product is withdrawn therefrom via line 52, and vapor effluent is withdrawn via line 54 at a temperature of e.g. 100–200° F. To recover light hydrocarbons therefrom, the vapor effluent is passed through an air cooler 56 and thence via line 58, at a temperature of e.g. 100°–150° F, into separator 60, from which light hydrocarbon condensate is withdrawn via line 62.

Overhead product gas from separator 60 comprising mainly light hydrocarbons, hydrogen and carbon oxides, as well as some suspended shale oil mist, is taken overhead via line 64 and passed through a demisting unit 66 which may comprise a conventional circulating oil scrubber. The resulting demisted gas in line 68 is then divided into three streams, a net make gas taken off in line 74, a heating gas stream via line 76 for firing preheater 72, and the recycle stream which is passed via line 70 through preheater 72 and recycled via line 9 as previously described.

The foregoing constitutes an illustration of the preferred solids-upflow mode of retorting. However, the same basic principle of the invention can also be applied to solids-downflow retorting. As previously noted, in solids-downflow retorting the rock pressure exerted on the 750°–850° F retorting zone by the weight of solids in the cool, upper shale preheating zone can be excessive. But this problem can be overcome by physically separating the preheating zone from the retorting zone by conventional means such as those illustrated in U.S. Pat. Nos. 3,475,319 and 3,384,569.

The following example is cited to illustrate the invention, but is not to be construed as limiting in scope:

EXAMPLE

Figure 2:
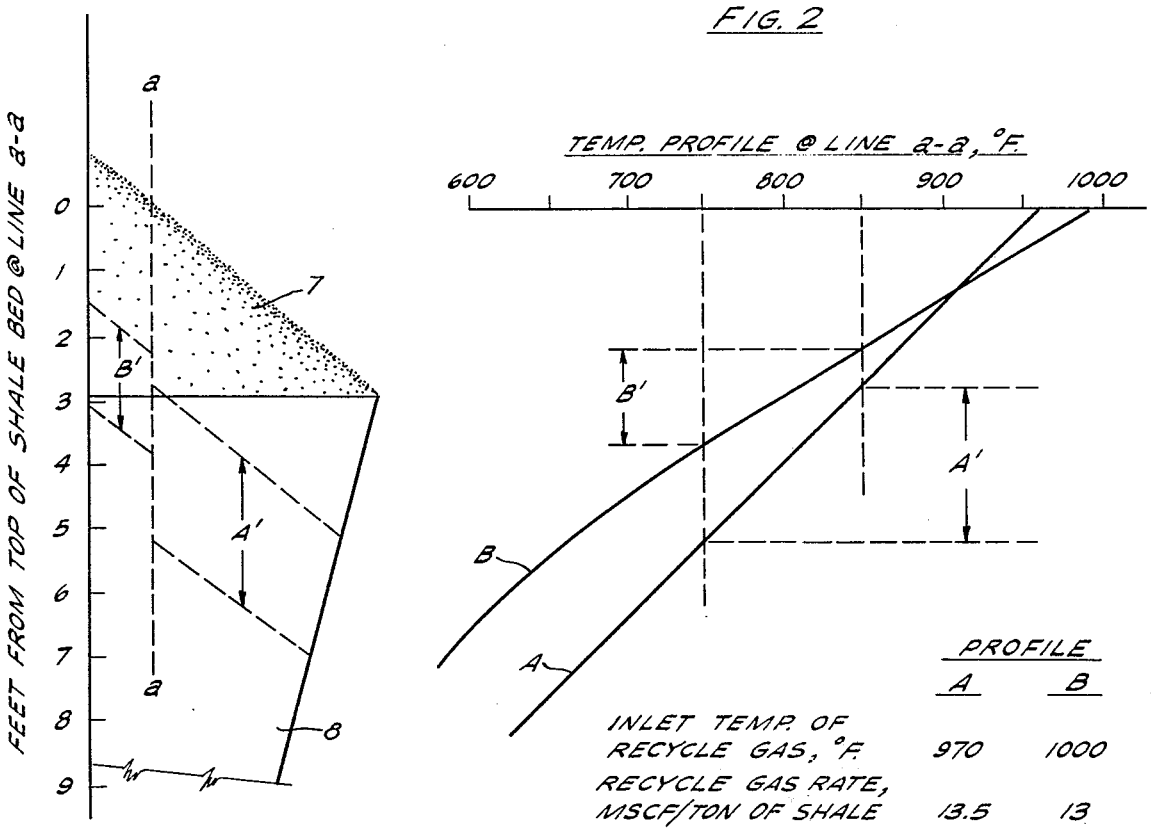
FIG. 2 is a graph depicting temperature profiles derived from the example hereinafter presented. These profiles, A and B, are taken along line a-a of FIGS. 1 and 2.

A commerical 10,000 ton per day retort similar to that illustrated in FIG. 1 is being fed 34 gallon per ton shale (Fischer assay) crushed to particles of average diameter ranging between ⅛-inch and 2 inches. The recycle gas rate is 13,500 scf/ton of shale and the recycle gas inlet temperature is 970° F. Under these conditions the shale bed temperature increases at a rate of about 39° F per foot of bed height and the temperature increase is approximately uniform throughout the bed. The resulting temperature profile is depicted by Graph A of FIG. 2. Under these operating conditions no problem of shale agglomeration is encountered. From FIG. 2 it will be noted that the critical 750°–850° F interval, A′, in the retort is located between about 3 and 5 feet below the top of the bed, corresponding to a rock pressure of about 2 to 4 psi.

Upon switching the feed to a 40 gallon per ton shale, agglomeration problems are encountered within a few hours, as indicated by increased pressure drop through the retort. To avoid agglomeration and plugging, the recycle gas rate is decreased to 13,000 scf per ton of feed, and the recycle gas inlet temperature is increased to about 1000° F, giving the temperature profile depicted by Graph B of FIG. 2. Under these operating conditions, the rate of temperature increase of the shale bed in the top 4 feet of the retort increases to 67° per foot of bed height, and the critical 750°–850° F temperature interval, B′, is shifted upwardly to about 2 to 3.5 feet below the top of the shale bed, corresponding to a rock pressure of about 1.5 to 2.5 psi. Upon continued operation in this manner, agglomeration and plugging problems are soon overcome. Moreover, this result is obtained without excessive reduction in gas flow rate, which would require excessively high recycle gas temperatures, which in turn would cause rapid coking of the preheater and excessive thermal cracking of hydrocarbons in the recycle gas stream, as well as in the upper portion of the shale bed. However, some small increase in thermal cracking does result, with slightly reduced yields, and hence upon returning to the original 34 gallon/ton shale feed, it would be desirable to shift back to the original recycle gas rate and temperature. The possibility of thermal cracking can readily be appreciated from the composition of the recycle gas, which is as follows:

Table 1

| Component | Mol - % |
|---|---|
| $H_2$ | 26.3 |
| $CH_4$ | 24.1 |
| $CO_2$ | 11.6 |
| $H_2O$ | 7.3 |
| CO | 6.4 |
| $H_2S$ | 2.0 |
| $C_2$–$C_5$ Hydrocarbons | 20.0 |
| $C_6^+$ Hydrocarbons | 2.0 |

The following claims and their obvious equivalents are believed to define the true scope of the invention.

We claim:

1. In a shale retorting process wherein a vertically moving compact bed of crushed oil shale is countercurrently contacted in a retorting zone with a preheated eduction gas to thereby educe oil and product gases from said shale, a portion of said product gases being recycled as said eduction gas, and wherein a temperature gradient is thereby established in said retorting zone including a maximum temperature between about 900° – 1100° F at the solids outlet end of said retorting zone, and an intermediate temperature of 800° F between the two extremities of said retorting zone, and wherein the oil assay of shale fed to said retorting zone varies susbstantially from time to time, the improved method for preventing agglomeration of said crushed shale at any point in said bed, which comprises correlating the inlet temperature of said eduction gas with the flow rate thereof in response to the oil assay of said shale, so as to shift said intermediate temperature downwardly in said bed when said oil assay declines, and upwardly in said bed when the oil assay increases, whereby the rock pressure bearing on said intermediate temperature zone is at all times insufficient to bring about significant shale agglomeration.

2. A process as defined in claim 1 wherein said oil shale is passed upwardly through said retorting zone.

3. A process as defined in claim 1 wherein said oil shale is gravitated downwardly through said retorting zone.

4. A process as defined in claim 1 wherein, during a first cycle of operation said oil shale has a Fischer assay above about 35 gallons per ton, and said eduction gas is preheated to a temperature between about 980° and 1100° F.

5. A process as defined in claim 4 wherein, during a second cycle of operation said oil shale has a Fischer assay below about 35 gallons per ton, and said eduction gas is preheated to a temperature between about 925° and 1000° F.

6. A process as defined in claim 1 wherein said intermediate temperature of 800° F is at all times maintained at a level in said bed no lower than the level at which the total rock pressure bearing thereon is equal to about $(120{,}000/(\text{F.A.})^3) + 0.5$ psi, where F.A. is the Fischer assay of said shale, in gallons per ton.

7. In a shale retorting process wherein a bed of crushed oil shale is pumped serially upwardly through preheating and retorting zones countercurrently to a downflowing, preheated eduction gas to thereby educe oil and product gases from said shale, a portion of said product gases being recycled as said eduction gas, and wherein a temperature gradient is thereby established in said retorting zone including intermediate temperatures of 800° and 850° F and an upper maximum temperature between about 900° – 1100° F at the top of said shale bed, and wherein the oil assay of shale fed to said retorting zone varies substantially from time to time; the improved method for preventing agglomeration of said crushed shale at any point in said bed which comprises correlating the inlet temperature of said eduction gas with the flow rate thereof in response to the oil assay of said shale, so as to shift said 800° F intermediate temperature downwardly in said bed when said oil assay declines, and upwardly in said bed when the oil assay increases, whereby the rock pressure bearing on said 800° F intermediate temperature zone is at all times insufficient to bring about significant shale agglomeration, and so as to maintain said intermediate temperature of 850° F at a level at least about 1 foot below the top of said bed at all times.

8. A process as defined in claim 7 wherein, during a first cycle of operation, said oil shale has a Fischer assay above about 35 gallons per ton, and wherein the flow rate and temperature of said eduction gas are correlated so as to establish in the top 4 feet of said shale bed a temperature gradient of about 50° – 100° F per foot of bed height.

9. A process as defined in claim 8 wherein, during a second cycle of operation, said oil shale has a Fischer assay below about 35 gallons per ton, and wherein the flow rate and temperature of said eduction gas are correlated so as to establish in the top 4 feet of said shale bed a temperature gradient of about 25° – 50° F per foot of bed height.

10. A process as defined in claim 9 wherein the temperature profile throughout said retorting zone during said second cycle of operation is substantially linear.

11. A process as defined in claim 7 wherein said intermediate temperature of 800° F is maintained during each of said cycles at a level in said bed no lower than the level at which the total rock pressure bearing thereon is equal to about $(120{,}000/(\text{F.A.})^3) + 0.5$ psi, where F.A. is the Fischer assay of said shale, in gallons per ton.

12. A process as defined in claim 7 wherein said eduction gas is preheated to a temperature between about 950° and 1200° F.

13. A process as defined in claim 7 wherein said retorting zone is maintained at a pressure between about 10 – 50 psig.

14. A process as defined in claim 7 wherein said relatively rich shale feed Fischer assays at least about 5 gallons per ton higher than said relatively lean shale feed.

15. In a shale retorting process wherein a vertically moving compact bed of crushed oil shale is countercurrently contacted in a retorting zone with a preheated eduction gas to thereby educe oil and product gases from said shale, a portion of said product gases being recycled as said eduction gas, and wherein a temperature gradient is thereby established in said retorting zone including a maximum temperature between about 900° – 1100° F at the solids outlet end of said retorting zone, and an intermediate temperature of 800° F between the two extremities of said retorting zone, the improved method for preventing agglomeration of said crushed shale at any point in said bed, which comprises correlating the inlet temperature of said eduction gas with the flow rate thereof so as to maintain said intermediate temperature at a level in said bed no lower than the level at which the total rock pressure bearing thereon in pounds per square inch is equal to about $(120{,}000/(\text{F.A.})^3) + 0.5$, where F.A. is the Fischer assay of said shale, in gallons per ton.

16. A process as defined in claim 15 wherein said oil shale is passed upwardly through said retorting zone.

17. A process as defined in claim 15 wherein said oil shale is gravitated downwardly through said retorting zone.

18. A process as defined in claim 15 wherein said eduction gas is preheated to a temperature between about 980° and 1100° F, and said oil shale has a Fischer assay above about 35 gallons per ton.

19. A process as defined in claim 15 wherein said eduction gas is preheated to a temperature between about 925° and 1000° F, and said oil shale has a Fischer assay below about 35 gallons per ton.

20. In a shale retorting process wherein a bed of crushed oil shale is pumped serially upwardly through preheating and retorting zones countercurrently to a downflowing, preheated eduction gas to thereby educe oil and product gases from said shale, a portion of said product gases being recycled as said eduction gas, and wherein a temperature gradient is thereby established in said retorting zone including intermediate temperatures of 800° and 850° F and an upper maximum temperature between about 900° – 1100° F at the top of said shale bed, the improved method for preventing agglomeration of said crushed shale at any point in said bed which comprises correlating the inlet temperature of said eduction gas with the flow rate thereof so as to (1) maintain said intermediate temperature of 800° F at a level in said bed no lower than the level at which the total rock pressure bearing thereon in pounds per square inch is equal to about $(120{,}000/(F.A.)^3) + 0.5$, where F.A. is the Fischer assay of said shale, in gallons per ton, and (2) maintain said intermediate temperature of 850° F at a level at least about 1 foot below the top of said bed.

21. A process as defined in claim 20 wherein said oil shale has a Fischer assay above about 35 gallons per ton, and wherein the flow rate and temperature of said eduction gas are correlated so as to establish in the top 4 feet of said shale bed a temperature gradient of about 50° – 100° F per foot of bed height.

22. A process as defined in claim 20 wherein said oil shale has a Fischer assay below about 35 gallons per ton, and wherein the flow rate and temperature of said eduction gas are correlated so as to establish in the top 4 feet of said shale bed a temperature gradient of about 25° – 50° F per foot of bed height.

23. A process as defined in claim 22 wherein the temperature profile throughout said retorting zone is substantially linear.

24. A process as defined in claim 20 wherein said intermediate temperature of 800° F is maintained at a level no lower in said retorting zone than the level at which the total rock pressure bearing thereon is equal to about $(100{,}000/(F.A.)^3) + 0.5$ psi, where F.A. is the Fischer assay of said shale, in gallons per ton.

25. A process as defined in claim 20 wherein said eduction gas is preheated to a temperature between about 950° and 1200° F.

26. A process as defined in claim 20 wherein said retorting zone is maintained at a pressure between about 10 – 50 psig.

* * * * *